US006202571B1

(12) United States Patent
Pallares

(10) Patent No.: US 6,202,571 B1
(45) Date of Patent: Mar. 20, 2001

(54) LOCK MECHANISM FOR FOLDING LEG

(75) Inventor: Ademar Pallares, Brampton (CA)

(73) Assignee: Spec Furniture Inc., Concord (CA)

( * ) Notice: Subject to any disclaimer, the term of this patent is extended or adjusted under 35 U.S.C. 154(b) by 0 days.

(21) Appl. No.: 09/361,135

(22) Filed: Jul. 27, 1999

(51) Int. Cl.[7] ..... A47B 3/00
(52) U.S. Cl. ..... 108/132; 108/179
(58) Field of Search ..... 108/130, 131, 108/132, 133, 115, 179

(56) References Cited

U.S. PATENT DOCUMENTS

| | | | | |
|---|---|---|---|---|
| 166,263 | * | 8/1875 | Crawford | 108/132 |
| 1,203,783 | * | 11/1916 | Reischmann | 108/132 |
| 2,921,825 | * | 1/1960 | Spiegal | 108/132 |
| 3,267,886 | * | 8/1966 | Glass | 108/132 |
| 4,064,815 | * | 12/1977 | Baum | 108/132 |

* cited by examiner

*Primary Examiner*—Peter M. Cuomo
*Assistant Examiner*—Jerry A. Anderson
(74) *Attorney, Agent, or Firm*—Bereskin & Parr

(57) ABSTRACT

A lock system for releasably locking a first component, pivotally coupled along a pivot axis to a second component, in a plurality of positions fixed relative to the second component. The system includes a first engaging mechanism fixed to the first component and aligned with the pivot axis such that it rotates in a rotation plane substantially perpendicular to the pivot axis when the first component is pivoted relative to the second component. The system also includes a second engaging mechanism pivotally mounted to the second component and movable between a first engaged position in which the second engaging mechanism fixedly engages with the first engaging mechanism, preventing the first component from pivoting relative to the second component, and a second disengaged position removed from the first engaging mechanism wherein the first component is free to pivot relative to the second component.

20 Claims, 11 Drawing Sheets

LOCK MECHANISM FOR FOLDING LEG

FIELD OF THE INVENTION

This invention relates to the field of folding support legs.

BACKGROUND OF THE INVENTION

Some prior art folding table legs comprise an articulated cross-support mechanism which spans between the leg and the underside of the tabletop. Often, the cross-support mechanism has a hinge in its middle which permits it to fold back upon itself when the leg is collapsed against the tabletop, but which is designed to prevent the cross-support from pivoting much past 180° at its full extension, when the leg is erected. These cross-supports maintain their spanning strength through the use of gravity or some form of friction lock which works to keep the cross-support extended. Such support legs tend to be flimsy and easily collapsed by accident once erected.

Alternatively, some cross-support mechanisms are locked in their extended position through the use of a locking pin. While such mechanisms tend to be more secure in maintaining the leg in its erect position, the locking pins are frequently difficult to use. If the pin is lost, the table leg is rendered unusable until a replacement is found. Frequently, the locking pins are attached to the table through the use of a lengthy chain, which can become tangled when the table leg is collapsed.

Other devices have been developed to improve the stability of the collapsible legs, and to lock them in the erect position. However, such designs tend to be complex, both from the manufacturing standpoint, and from the user's perspective.

Additionally, many collapsible table leg designs fail to provide a retention device for maintaining the table leg in its collapsed position. In order to keep the legs from extending and becoming obstructive, it is typically necessary to ensure that the table is transported and stored in an upside-down position.

Accordingly, it has been recognized that there is a need for a collapsible table support mechanism, which is sturdy, simple to use, and which is capable of locking the support in both its collapsed and extended positions.

SUMMARY OF THE INVENTION

The present invention is directed towards a collapsible support mechanism, which has common, but by no means exclusive application to folding table legs.

The lock system of the present invention is for releasably locking a first component, pivotally coupled along a pivot axis to a second component, in a plurality of positions fixed relative to the second component. The system has a first engaging mechanism fixed to the first component and aligned with the pivot axis such that it rotates in a rotation plane substantially perpendicular to the pivot axis when the first component is pivoted relative to the second component. The system also has a second engaging mechanism pivotally mounted to the second component and movable between an engaged position in which the second engaging mechanism fixedly engages with the first engaging mechanism, preventing the first component from pivoting relative to the second component, and a disengaged position removed from the first engaging mechanism wherein the first component is free to pivot relative to the second component.

BRIEF DESCRIPTION OF THE DRAWINGS

The present invention will now be described, by way of example only, with reference to the following drawings, in which like reference numerals refer to like parts and in which.

DETAILED DESCRIPTION OF THE PREFERRED EMBODIMENT

Figures 1, 1A, 1B:
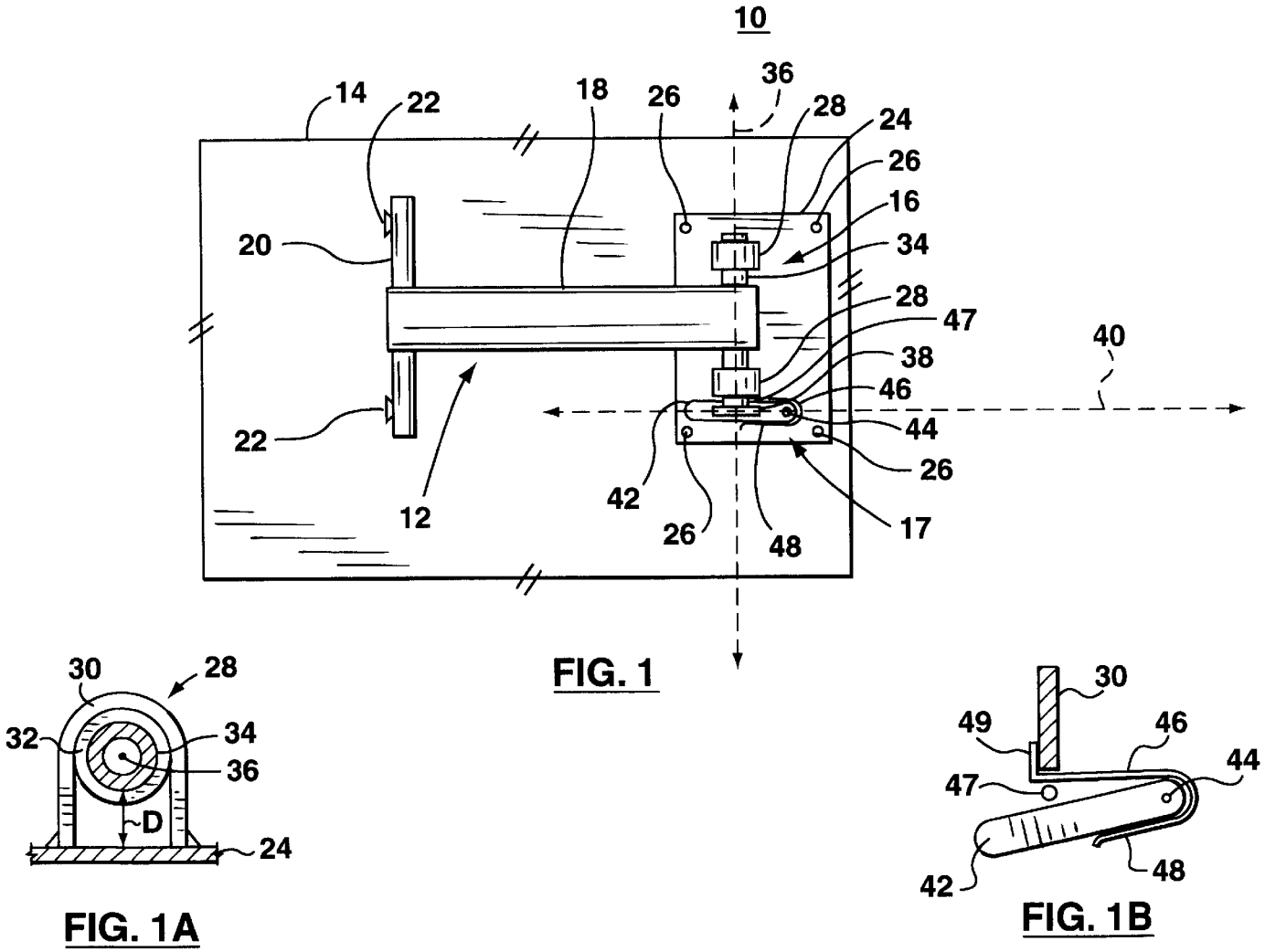
FIG. 1 is a bottom plan view of a locking mechanism manufactured in accordance with the subject invention, in which the support is locked in a collapsed position.
FIG. 1A is a side sectional view of a hinge knuckle of the locking mechanism in FIG. 1.
FIG. 1B is an overhead view of the engaging bar and spring in FIG. 1, with portions of the hinge mechanism removed.
Figure 2:
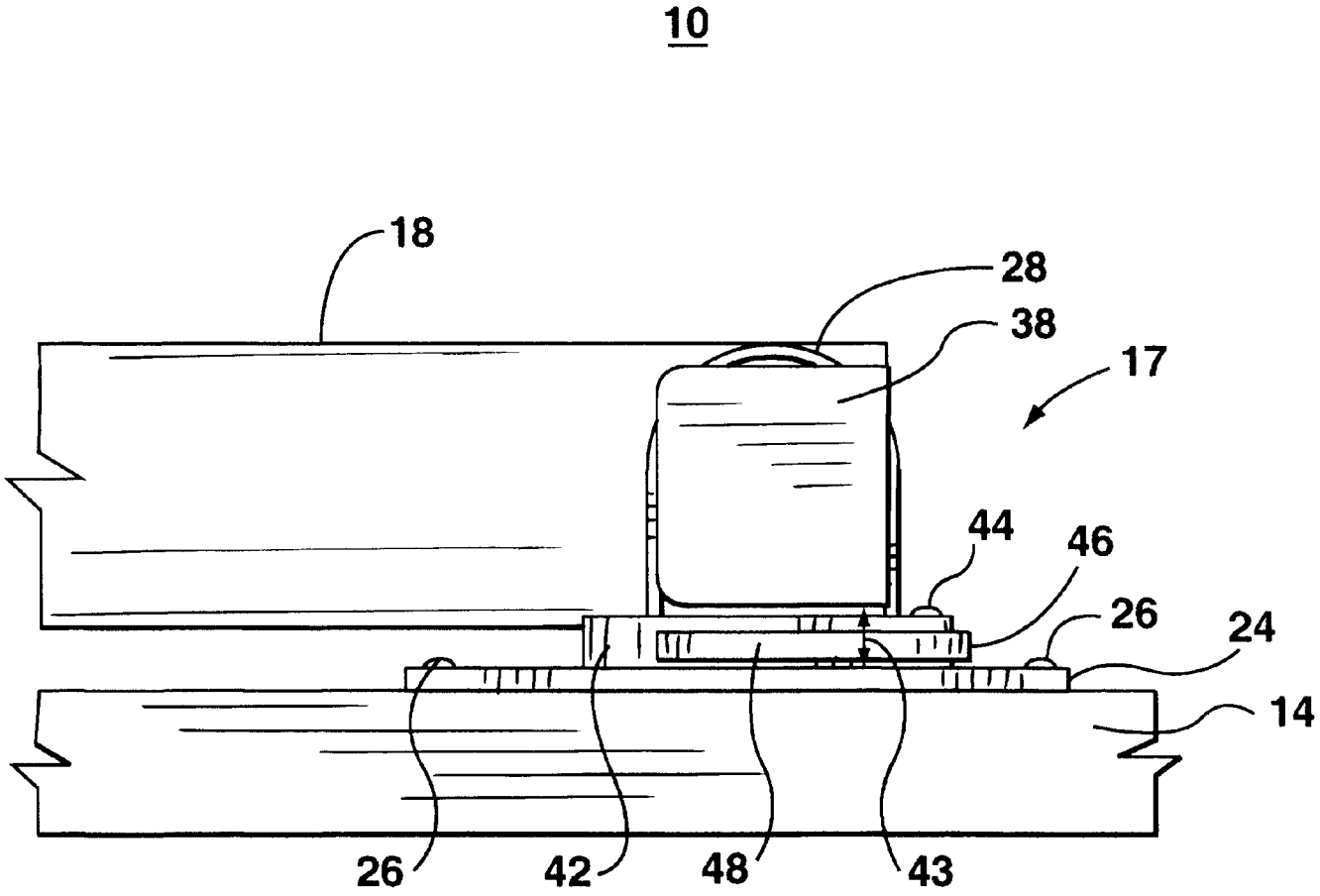
FIG. 2 is a side, close-up view of the locking mechanism of FIG. 1, in which the support is locked in a collapsed position.

Referring simultaneously to FIGS. 1 and 2, illustrated therein is a lock system, shown generally at 10 and made in accordance with a preferred embodiment of the subject invention. Lock system 10 comprises a first component 12, pivotally coupled to a second component 14 through the use of a hinge mechanism 16, and a locking mechanism 17. The first component 12 is shown locked in its collapsed position.

Typically, the first component 12 is a support member, such as a table leg, and correspondingly, typically the second component 14 is a tabletop. Preferably, the first component 12 comprises a main stem 18 (eg. a tube) having a base stabilizing member 20, which provides lateral stability when in contact with the floor when the leg is in its erect position. Base member 20 may also comprise adjustable feet 22, which may be screwed in and out for height adjustment with respect to the base member 20, for optimal contact with the floor, as will be understood by one skilled in the art. In the example shown, main stem 18 is of tubular metal construction, typically cylindrical in shape, through which the base member 20, also typically of tubular metal construction, has been passed.

The hinge mechanism 16 comprises a support plate 24 which is mounted to the underside of the tabletop 14, typically through the use of mounting screws 26. Hinge knuckles 28 are typically welded to the support plate 24, and comprise a U-shaped portion 30, within which tube segment 32 has been mounted (FIG. 1A). Tube segment 32 is sized to slidably receive hinge pin 34 (which also may be tubular). Hinge pin 34 is fixedly mounted through the main stem 18, typically through welding the two components together. Hinge pin 34 is aligned to pivot about a pivot axis 36, shown by the dotted line. The periphery of hinge pin 34 is spaced by distance D (FIG. 1A) from the adjacent surface of plate 24, for a purpose which will become apparent.

The locking mechanism 17 comprises a first engaging mechanism 38, typically a substantially square metal locking plate, which is fixed (eg. by welding) to one end of the hinge pin 34. The locking plate 38 is centrally aligned to substantially rotate about the pivot axis 36, in a rotation plane 40, represented by a dotted line, which is substantially perpendicular to the pivot axis 36 and to the paper on which FIG. 1 is printed. The locking mechanism is shown in FIGS. 1 and 2 in its engaged or locked position.

The locking mechanism 17 also comprises a second engaging mechanism 42, typically a substantially rectangular bar, which is pivotally mounted to the support plate 24 through the use of a screw 44 extending through a hole in the bar 42. The hole in the bar 42 is sized to permit the bar 42 to freely pivot about the screw 44, while pivotally fixing the bar 42 to the support plate 24. Preferably, the locking mechanism 17 also includes a U-shaped biasing spring element 46, mounted to the nearest hinge knuckle 28. A reinforcing pin 47 (see also FIG. 1B) may also be provided, mounted to the support plate 24 and positioned on the interior of the spring 46, with the spring 46 passing between the pin 47 and the nearest knuckle 28 and then bent at 49 against the inside of U-shaped member 30. The spring 46 is sized to fit around the pivoting end of the bar 42, and has a free, flexing arm 48, which maintains biasing force against the bar, urging it towards the nearest knuckle 28.

The bar 42 is positioned in the gap 43 (FIG. 2) between the locking plate 38 and the support plate 24. Gap 43 is part of the distance D shown in FIG. 1A. In this engaged position, the bar 42 prevents the locking plate 38 from rotating to any substantial degree, and thereby locks the table leg 12 in its collapsed position.

Figure 3:
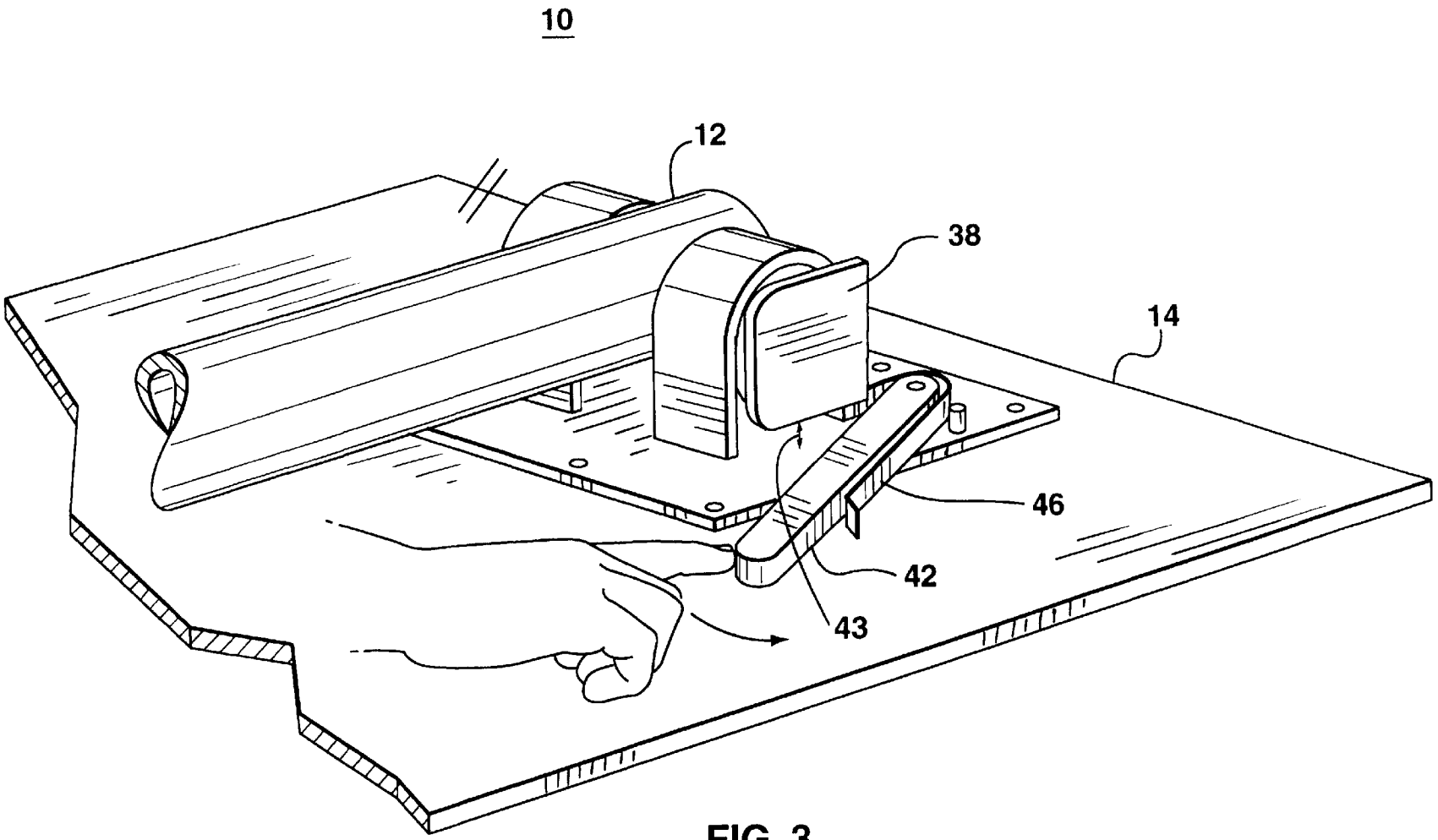
FIG. 3 is a bottom perspective, close-up view of the locking mechanism of FIG. 1, in which the lock mechanism is disengaged, and the support is in the collapsed position of FIG. 2.

Referring now to FIG. 3, the table leg 12 is shown in the collapsed position of FIG. 2. A user has exerted and maintained counter force against the biasing force of the flexing arm 48 of the spring 46 and flexed it outward, by pivoting the free end of the bar 42 outward in the direction of the arrow, away from the nearest hinge knuckle 28, and out of the gap 43. As a result, the locking mechanism 17 is disengaged or unlocked, and the table leg 12 is freed to rotate towards a vertical, erect position.

Figure 4:
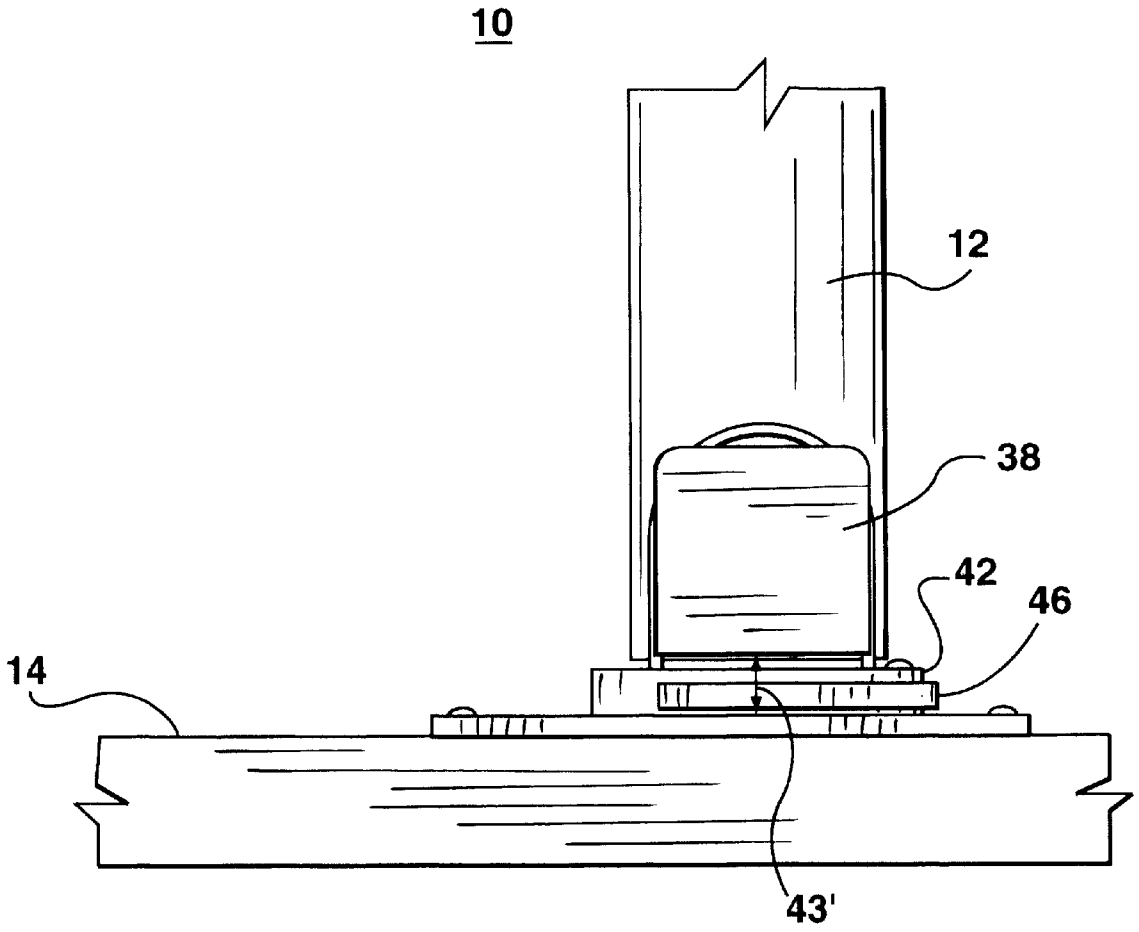
FIG. 4 is a side, close-up view of the locking mechanism of FIG. 1, in which the support is locked in an erect position.

In FIG. 4, the table leg 12 has been rotated approximately 90° to its erect position. As a result, the locking plate 38 has correspondingly been rotated approximately 90°. In the same fashion as was illustrated in FIG. 2, the bar 42 is positioned between the locking plate 38 and the support plate 24, and in this engaged position, the bar 42 again prevents the locking plate 38 from rotating to any substantial degree. As a result, the table leg 12 is locked in its erect position.

Figure 5:
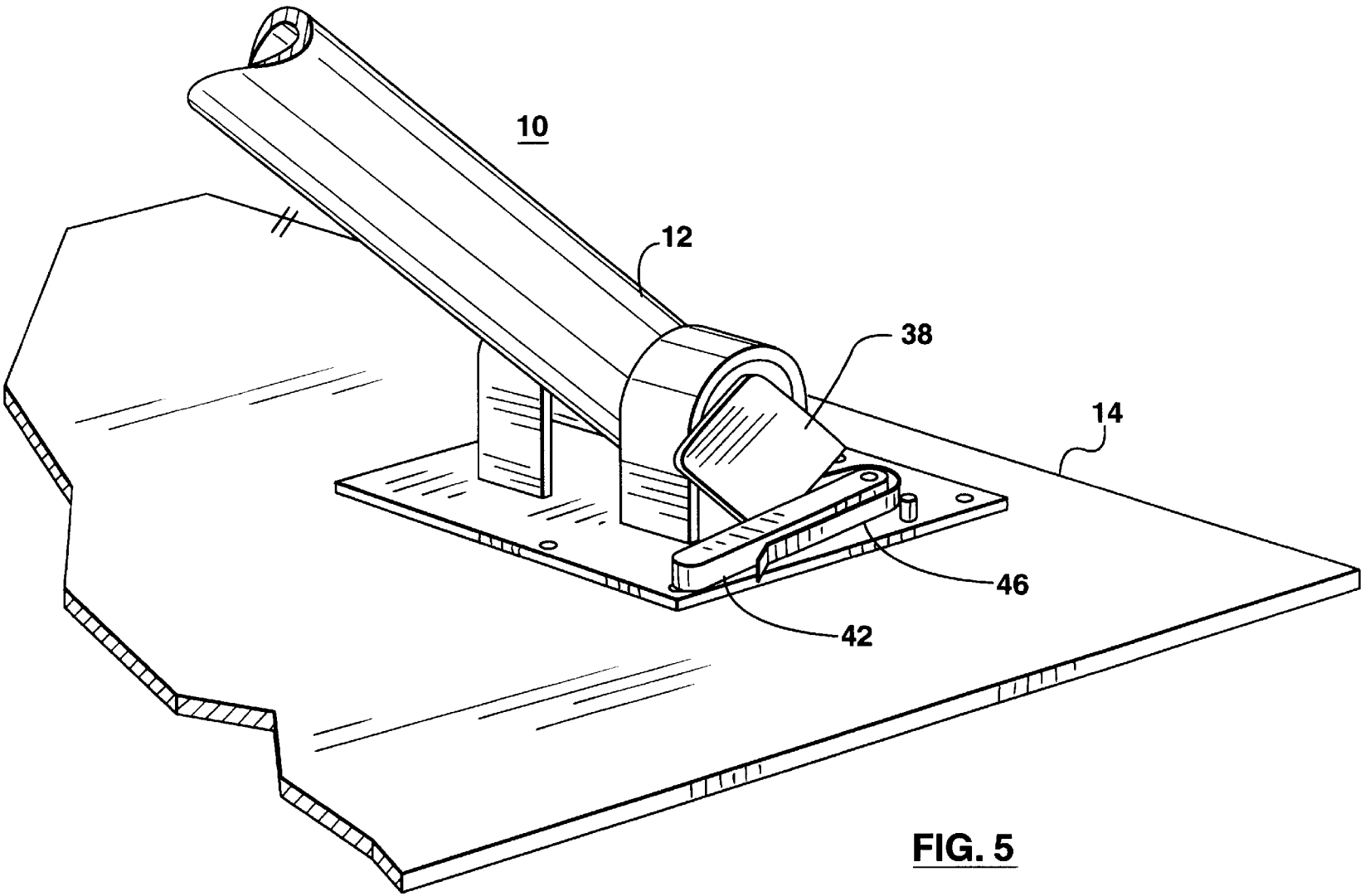
FIG. 5 is a bottom perspective, close-up view of the locking mechanism of FIG. 1, in which the lock mechanism is disengaged, and the support has been moved between the collapsed position of FIG. 2 and the erect position of FIG. 4.

Referring now to FIG. 5, the table leg 12 is shown part way between the collapsed position of FIGS. 2 and 3 and the erect position of FIG. 4. When in the disengaged position of FIG. 5, the table leg 12 has been rotated toward the vertical. In this position, the bottom corner of the locking plate 38 has been rotated and projects into the space which had previously formed the gap 43 in FIG. 2. As a result, when the bar 42 has been released by the user, the spring 46 urges the bar 42 into contact with the outer surface of the locking plate 38. As shown in FIG. 5, the lock system 10 may also include a peg 50 for preventing over extension of the spring 46 when the bar 42 is flexed outward by the user.

Once the table leg 12 has been rotated completely into the erect position of FIG. 4, a new gap 43' is formed between the bottom side of the locking plate 38 and the support plate 24, and the spring 46 urges the bar 42 to snap into the newly formed gap 43', thereby preventing further rotation of the table leg 12.

Figure 6:
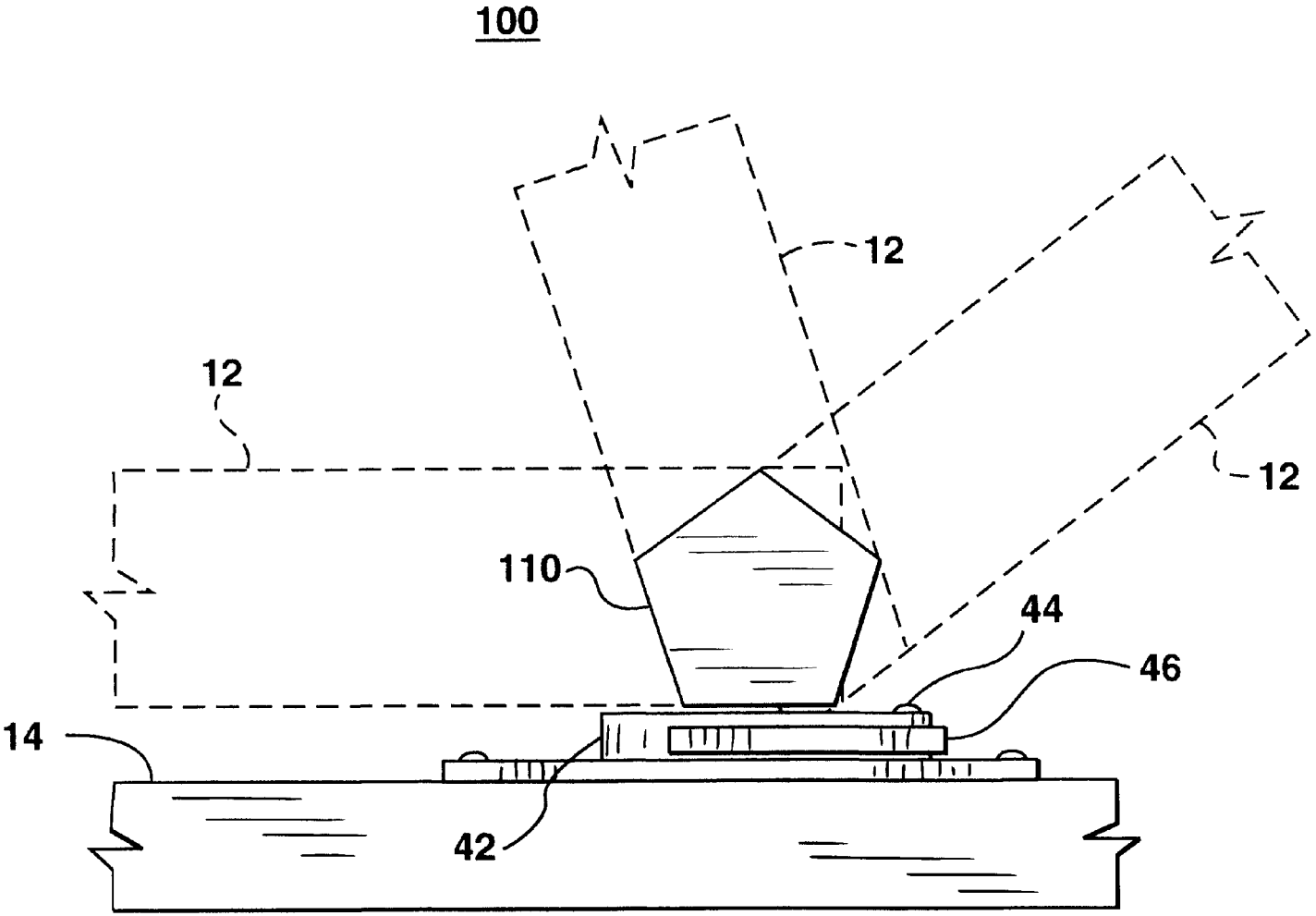
FIG. 6 is a side, close-up view of an alternate locking mechanism of the subject invention, in which the plate of the first engaging mechanism is substantially pentagonal in shape.

Reference is next made to FIG. 6, which shows an alternate locking mechanism shown generally as 100. As indicated through the use of similar reference numbers used in FIGS. 1 to 5, the various components of the alternate mechanism 100 are largely identical to those of the lock system 10. However, the locking plate 38 has been replaced with metal plate 110 which is substantially pentagonal in shape. As shown in dotted outline, this configuration permits the first component 12 to be locked into three different positions with respect to the second component 14, each varying by approximately 72° from the next immediate position.

Figure 7:
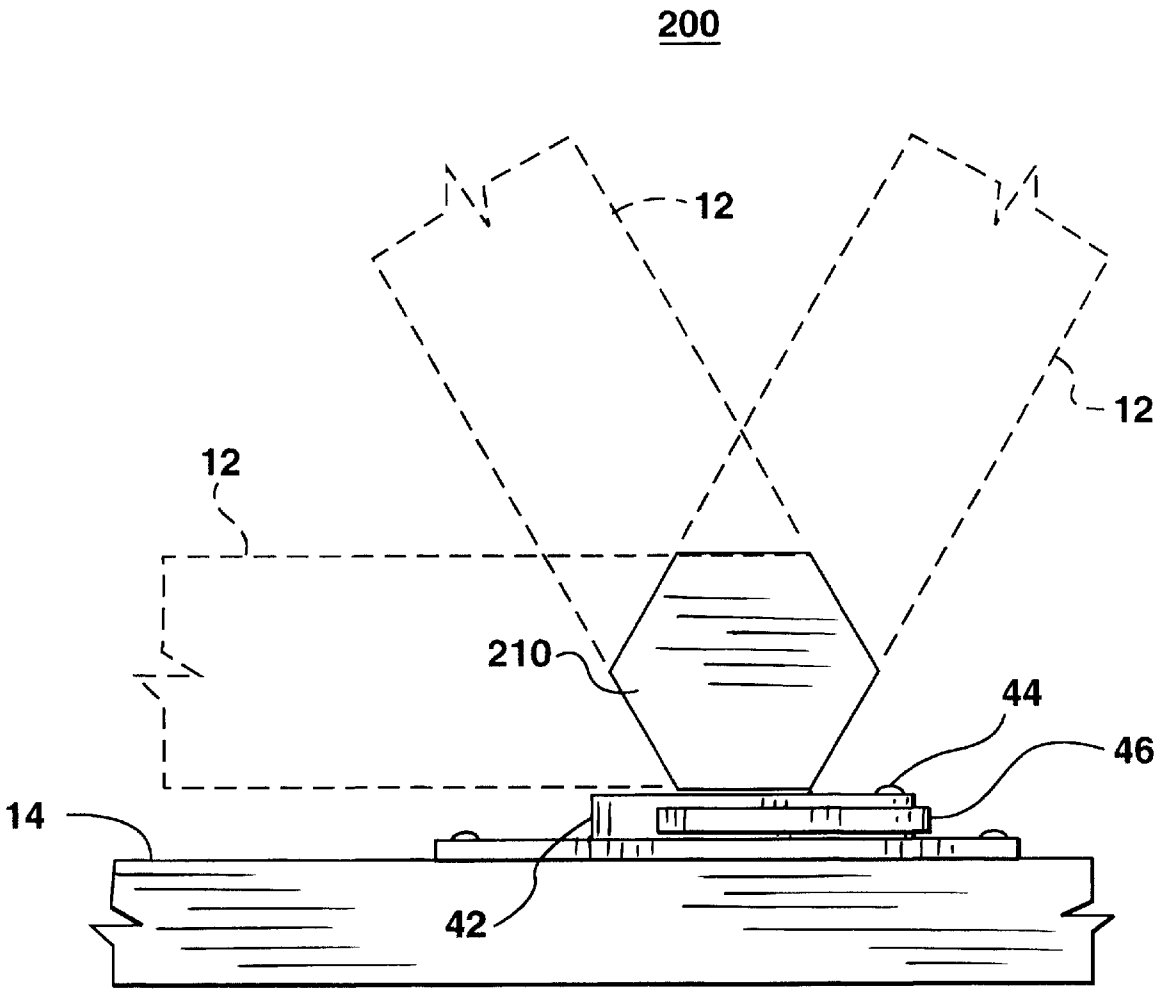
FIG. 7 is a side, close-up view of an alternate locking mechanism of the subject invention, in which the plate of the first engaging mechanism is substantially hexagonal in shape.

Referring now to FIG. 7, illustrated therein is an alternate locking mechanism shown generally as 200. As indicated through the use of similar reference numbers used in FIGS. 1 to 5, the various components of the alternate mechanism 200 are largely identical to those of the lock system 10. However, the locking plate 38 has been replaced with metal plate 210 which is substantially hexagonal in shape. As shown in dotted outline, this configuration permits the first component 12 to be locked into three different positions with respect to the second component 14, each varying by approximately 60° from the previous position.

While the collapsed position of the first component 12 is illustrated in FIGS. 6 and 7 as being essentially parallel to the second component 14, it should be understood that for certain uses, it may be preferable for the collapsed position to have the first component 12 at some positive angle with respect to the second component 14. As will be understood, providing for different angles in this manner involves fixing the locking plate 110 or 210 to the hinge pin 34 (not shown in FIGS. 6 and 7), and hence to the first component 12 at a different angle than illustrated. Furthermore, it should be understood that the locking plates 38, 110, 210 may be replaced with locking plates that comprise more than 6 sides. Additionally, it should be understood the locking plates do not need to be regular polygons. In general, any appropriately sized and shaped locking plate having at least two flat sides at its periphery may be used. Typically, the larger the number of sides on the locking plate, the greater the number of adjustable positions available, with smaller angular increments between consecutive positions.

Figure 8A:
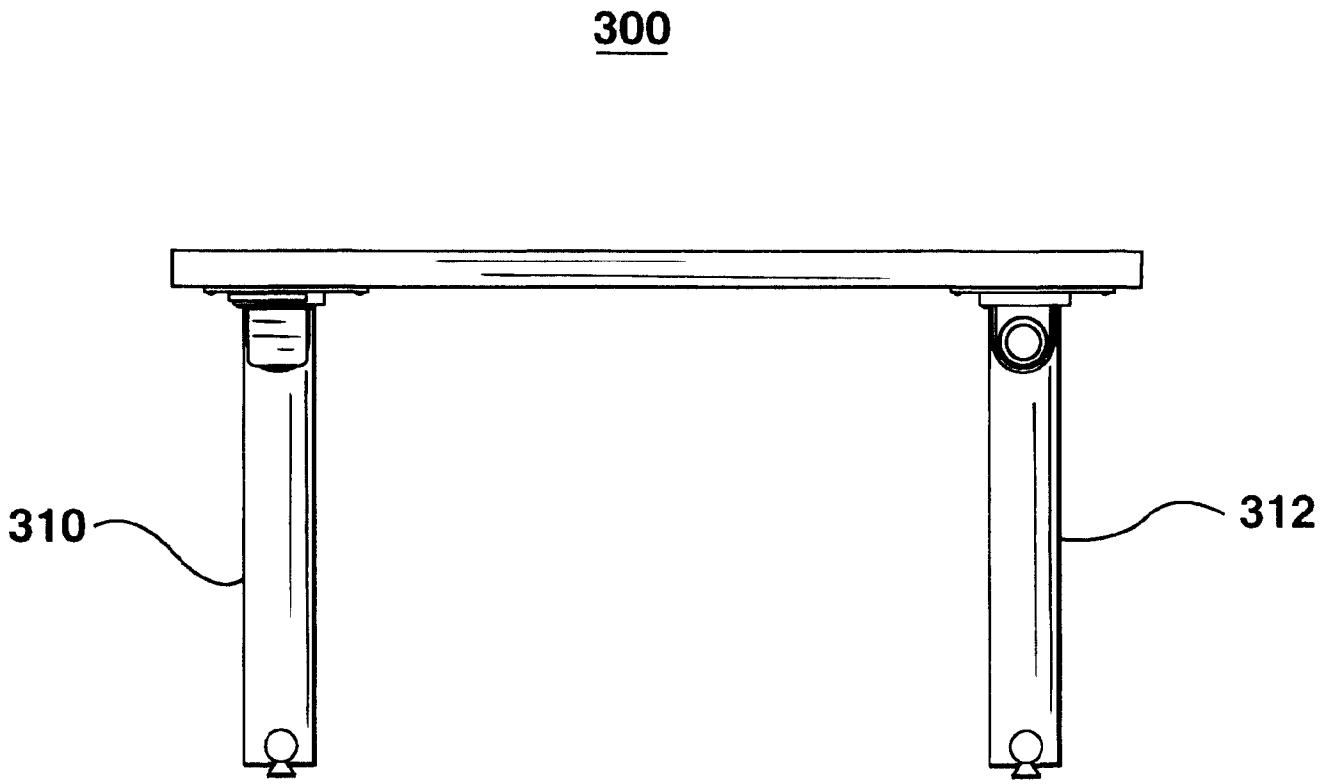
FIG. 8A is a side view of a table comprising collapsible legs utilizing the locking mechanism of FIG. 1, in which the legs are locked in an erect position.
Figure 8B:
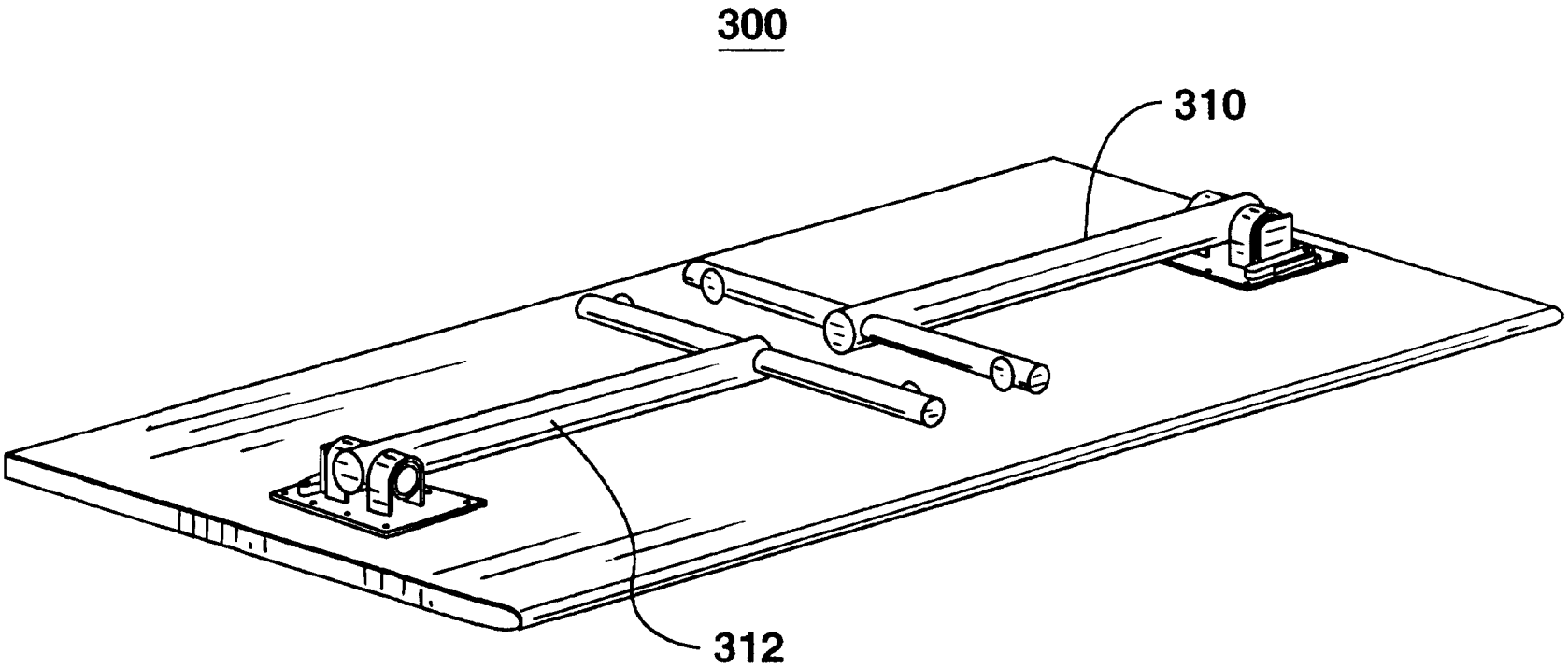
FIG. 8B is a bottom perspective view of the table of FIG. 8A, in which the legs are locked in a collapsed position.

Referring now to FIG. 8A, illustrated therein is a table, referred to generally as 300 comprising a pair of collapsible legs 310, 312 each utilizing the locking mechanism of the subject invention. The legs 310, 312 are shown locked in an erect position. In FIG. 8B, the table 300 is shown with the legs 310, 312 in the collapsed position.

Figure 9:
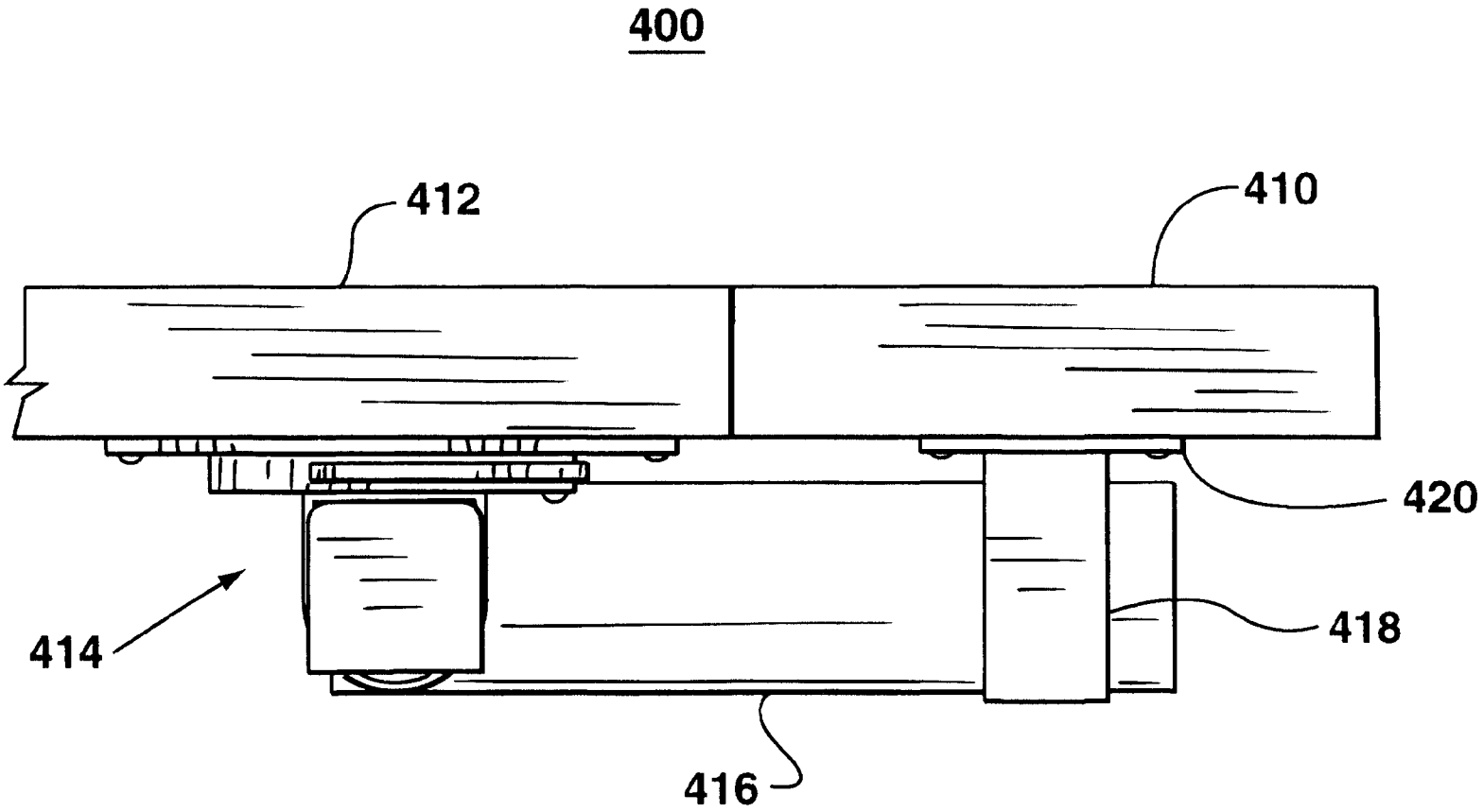
FIG. 9 is a side view of a collapsible table wing comprising a locking mechanisms manufactured in accordance with the subject invention, in which the table wing is locked in an extended, in use position.

Referring now to FIG. 9, illustrated therein is a locking system, referred to generally as 400, in which a table wing 410 is mounted to the edge of a tabletop 412 utilizing a mounting mechanism 414 which comprises components substantially similar to the hinge mechanism 16 and the locking mechanism 17 illustrated in FIGS. 1 and 2. Instead of the table leg 12 of FIGS. 1 and 2, the first component comprises an extension support 416 which is mounted to the table wing 410 by a U-shaped mounting bracket 418 which is welded to both the extension support 416 and a mounting plate 420 which, in turn, is screwed or bolted to the underside of the table wing 410. When not in use, the table wing 410 can be lowered approximately 90° and locked in a vertical position beneath the tabletop 412, or if the underside of the tabletop is free from obstruction, may be swung approximately 180° and locked in a position beneath and essentially parallel to the tabletop 412. As will be understood, the table support for the tabletop 412 may comprise fixed table legs, collapsible table legs (such as the table leg 12 of FIGS. 1 and 2), or the tabletop may simply be mounted to and extend from a wall.

Figure 10:
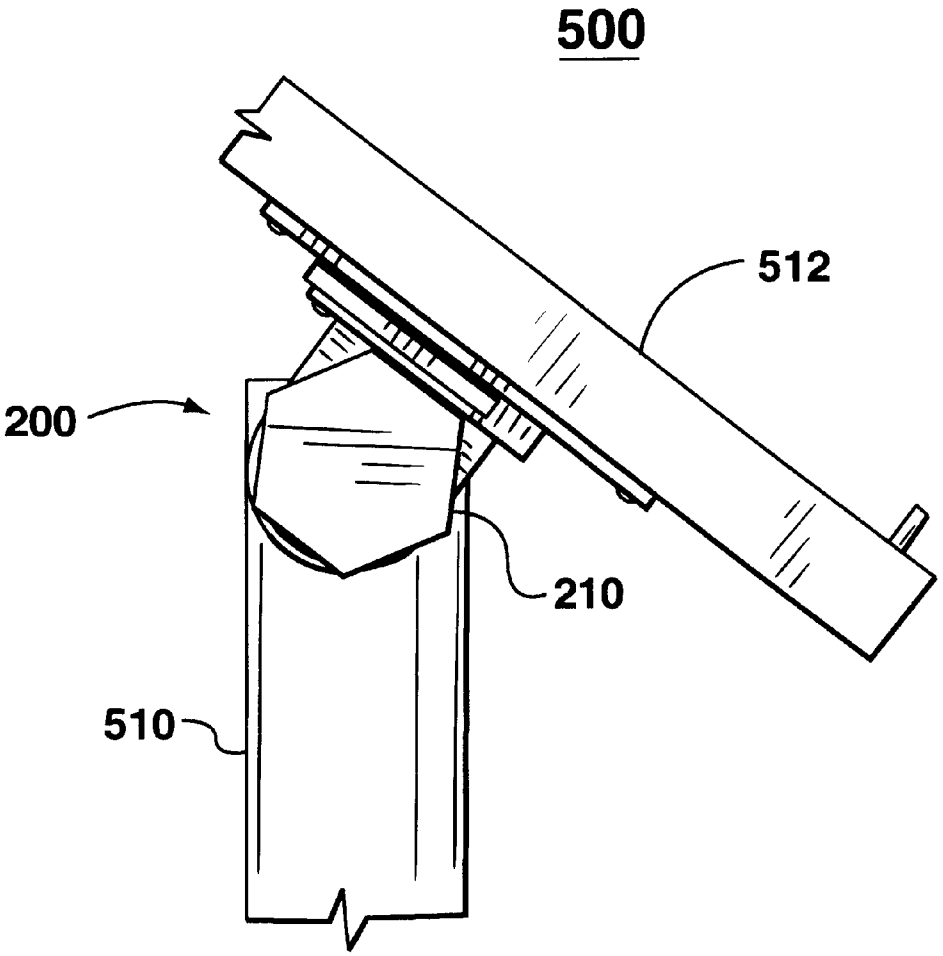
FIG. 10 is a side view of a drafting table comprising collapsible legs utilizing the locking mechanism of FIG. 7, in which the tabletop is locked in a position between the horizontal and vertical.

Referring now to FIG. 10 is the support mounting system 200 of FIG. 7, used on a drafting table, referred to generally as 500. For stability purposes, the table 500 utilizes two, laterally spaced mounting systems 200, each comprising a support leg 510 fixedly, pivotally mounted to the underside of the drafting tabletop 512. As will be understood, the tabletop 512 may be locked in several different positions with respect to the support legs 510, depending on the user's preferences. It should also be understood that the locking plate 210 can be replaced with any suitably sized and shaped locking plate, as mentioned previously.

While the various locking mechanisms have been illustrated and described in conjunction with tables, and generally in conjunction with table legs, it should be understood that the locking mechanism of the subject invention may be used for many different purposes in which it is desirable to pivotally mount one component to a second component, and be able to releasably lock the first component in position with respect to the second component.

Thus, while what is shown and described herein constitute preferred embodiments of the subject invention, it should be understood that various changes can be made without departing from the subject invention, the scope of which is defined in the appended claims.

I claim:

1. A lock system releasably locking a first component, pivotally coupled along a pivot axis to a second component, in a plurality of positions fixed relative to the second component, wherein the second component comprises a substantially flat surface having a surface plane. the lock system comprising:

(a) a first engaging mechanism fixed to the first component and aligned with the pivot axis such that the first engaging mechanism rotates in a rotation plane substantially perpendicular to the pivot axis when the first component is pivoted relative to the second component;

(b) a second engaging mechanism pivotally mounted to the second component, wherein the second engaging mechanism is movable between an engaged position and a disengaged position;

(c) wherein in the engaged position the second engaging mechanism fixedly engages with the first engaging mechanism, preventing the first component from pivoting relative to the second component, and wherein in the disengaged position the second engaging mechanism is removed from the first engaging mechanism such that the first component is free to pivot relative to the second component;

(d) wherein the first engaging mechanism comprises a plurality of substantially flat sides which are substantially perpendicular to the plane of rotation;

(e) wherein the first engaging mechanism is spaced from the flat surface such that when the first component is pivoted to align one of the flat sides of the first engaging mechanism substantially parallel to the flat surface, a gap is formed between the surface and said one side; and (f) wherein said second engaging mechanism is configured to substantially fill the gap. when the second engaging mechanism is in the engaged position.

2. The system as defined in claim 1, comprising a biasing element mounted to the second component for urging the second engaging mechanism towards the first engaged position.

3. The system as defined in claim 1, wherein the first component is a leg support.

4. The system as defined in claim 1, wherein the second component is a tabletop.

5. The system as defined in claim 1, wherein the gap is substantially rectangular.

6. The system as defined in claim 5, wherein the second engaging mechanism is a substantially rectangular bar having a first end, and wherein the bar is pivotally mounted to the second component at said first end.

7. The system as defined in claim 6, wherein the bar comprises a free second end which can be grasped by a user to move the bar between the engaged position and the disengaged position.

8. The system as defined in claim 6, wherein the first engaging mechanism is a substantially regular polygonal plate.

9. The system as defined in claim 8, comprising a biasing element mounted to the second component for urging the second engaging mechanism towards the first engaged position.

10. The system as defined in claim 8, wherein the plate is substantially square.

11. The system as defined in claim 9, wherein the plate and the bar are shaped such that when the bar is moved to the disengaged position and the plate is partly rotated, the plate has a portion extending into said gap so that the plate can be rotated with the bar urged against it, until one of the sides of the plate is substantially parallel to the surface of the second component, at which point the bar is biased into the gap, thereby preventing further rotation of the plate.

12. The system as defined in claim 8, wherein the first component can be moved between an erected and a folded position, and wherein the plate and the surface of the second component form a gap at both the erected position and the folded position, into which the bar is biased, thereby locking the first component in the erected position or the folded position.

13. The system as defined in claim 9, wherein said bar has a side and the biasing element comprises a spring having a U-shaped portion, and wherein one side of the U-shaped portion exerts biasing force against said side of the bar.

14. The system as defined in claim 1, wherein the first component is an extension support.

15. The system as defined in claim 14, wherein the extension support is mounted to a table wing.

16. A system comprising:

(g) a first component, pivotally coupled along a pivot axis to a second component, wherein the second component comprises a substantially flat surface having a surface plane;

(h) a first engaging mechanism fixed to the first component and aligned with the pivot axis such that the first engaging mechanism rotates in a rotation plane substantially perpendicular to the pivot axis when the first component is pivoted relative to the second component;

(i) a second engaging mechanism pivotally mounted to the second component, wherein the second engaging mechanism is movable between an engaged position and a disengaged position;

(j) wherein in the engaged position the second engaging mechanism fixedly engages with the first engaging mechanism, preventing the first component from pivoting relative to the second component, and wherein in the disengaged position the second engaging mechanism is removed from the first engaging mechanism such that the first component is free to pivot relative to the second component;

(k) wherein the first engaging mechanism comprises a plurality of substantially flat sides which are substantially perpendicular to the plane of rotation;

(l) wherein the first engaging mechanism is spaced from the flat surface such that when the first component is pivoted to align one of the flat sides of the first engaging mechanism substantially parallel to the flat surface, a gap is formed between the surface and said one side; and (m) wherein said second engaging mechanism is configured to substantially fill the gap, when the second engaging mechanism is in the engaged position.

17. The system as defined in claim 16, wherein the second engaging mechanism is a substantially rectangular bar having a first end, and wherein the bar is pivotally mounted to the second component at said first end.

18. The system as defined in claim 17, wherein the bar comprises a free second end which can be grasped by a user to move the bar between the engaged position and the disengaged position.

19. The system as defined in claim 17, wherein the first engaging mechanism is a substantially regular polygonal plate.

20. The system as defined in claim 17, wherein the first component can be moved between an erected and a folded position, and wherein the plate and the surface of the second component form a gap at both the erected position and the folded position, into which the bar may be inserted, thereby locking the first component in the erected position or the folded position.

* * * * *